United States Patent [19]

Granger

[11] 4,122,738

[45] Oct. 31, 1978

[54] APPARATUS FOR THE CUTTING AND SIMULTANEOUS DISPENSING OF A WEB OF ROLL MATERIAL

[76] Inventor: Maurice Granger, 28 rue Charles de Gaulle, 42000 Saint-Etienne-Loire, France

[21] Appl. No.: 814,931

[22] Filed: Jul. 12, 1977

Related U.S. Application Data

[62] Division of Ser. No. 671,818, Mar. 30, 1976, abandoned.

[30] Foreign Application Priority Data

Nov. 19, 1975 [FR] France ..... 75 36254

[51] Int. Cl.[2] ..... B26D 1/56

[52] U.S. Cl. ..... 83/314; 83/337; 83/298; 83/191; 83/352

[58] Field of Search ..... 83/337, 594, 285, 298, 83/314, 315, 191, 352, 602, 648, 335; 225/17, 47

[56] References Cited

U.S. PATENT DOCUMENTS

| | | | |
|---|---|---|---|
| 1,811,537 | 6/1931 | Cummings | 83/337 |
| 2,051,242 | 8/1936 | Birr et al. | 225/96 |
| 2,512,900 | 6/1950 | Kwitek | 242/58 X |
| 2,769,600 | 11/1956 | Kwitek et al. | 242/56 |
| 2,916,956 | 12/1959 | Salomon | 83/338 X |
| 3,641,857 | 2/1972 | Vande Castle | 83/337 X |
| 3,896,691 | 7/1975 | Granger et al. | 83/335 |

FOREIGN PATENT DOCUMENTS

| | | | |
|---|---|---|---|
| 23,061 of | 1908 | United Kingdom | 83/337 |

*Primary Examiner*—Willie G. Abercrombie
*Attorney, Agent, or Firm*—Haseltine, Lake & Waters

[57] ABSTRACT

Apparatus for cutting and simultaneously dispensing a web of roll material comprising a carrier for a roll of material mounted in a casing and urged against a rotatable drum which is driven in rotation by manual traction applied to a free end of the material extending from the casing. A profiled pawl is supported at one of the ends of the drum and cooperates with a shock absorber and an elastic abutment to brake the drum at the end of one revolution and hold it in readiness for a subsequent pull on the material. An eccentric lever is secured at the other end of the drum and is engaged by a spring such that in a first portion of rotation of the drum, the spring absorbs energy and after a dead point, it releases its energy to drive the drum in rotation. The drum has a longitudinal slot and a cutting member is pivotably mounted in the slot and carries a follower which cooperates with a fixed cam such that the cutting member is retracted in the drum in a inoperative position and projects from the slot in the drum in the operative position to produce a cut across the entire width of the material while the latter is maintained in tension on both sides of the cutting member.

23 Claims, 13 Drawing Figures

FIG.1
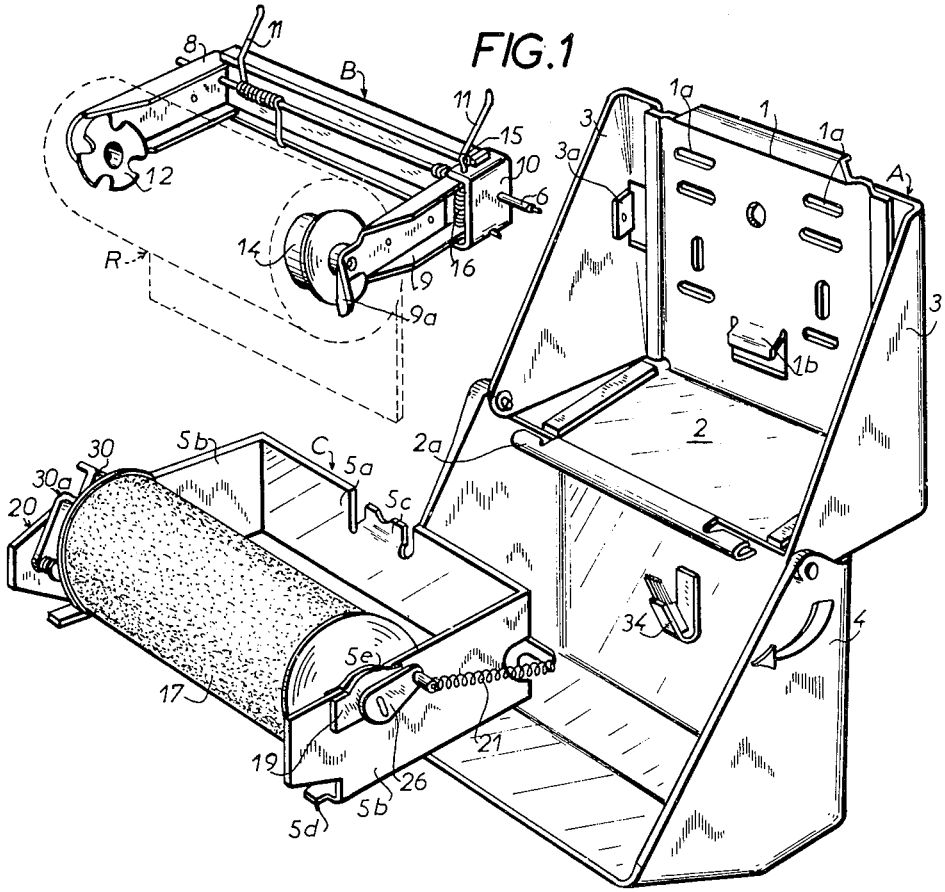
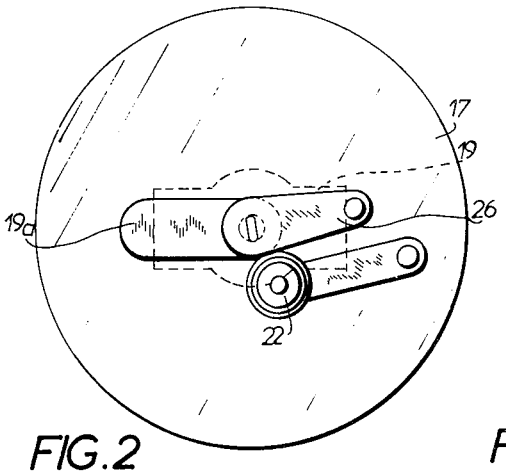
FIG.2
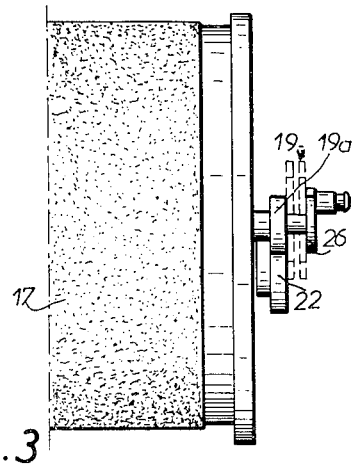
FIG.3

11
15
16
9
3
R
6
30a
17
28a
28
30
1b
31
32
29
5b
18
21
1
5d 30
30a
28c
29
28
18
32
31
33
28b
29a 30
30a
18
28c
29
28d
28
32
31
33

APPARATUS FOR THE CUTTING AND SIMULTANEOUS DISPENSING OF A WEB OF ROLL MATERIAL

CROSS-RELATED APPLICATION

This application is a division of Ser. No. 671,818 filed Mar. 30, 1976, now abandoned.

FIELD OF THE INVENTION

The invention relates to apparatus for the simultaneous cutting and feed of webs of roll material.

The invention is particularly directed to use with sanitary apparatus and to distributors or feed devices for paper, cotton wadding and the like.

BACKGROUND OF THE INVENTION

A number of devices and apparatus are known for the dispensing and the cutting of paper toweling or paper wadding. In some of them, the cutting of the paper is effected by tearing the pulled web or band against a toothed edge of the dispensor or distributor. In other apparatus, the cutting of the paper is effected by cutting the pulled band by means of a cutting tool mounted on the apparatus.

Also known is apparatus where the distribution and the cutting of the paper are simultaneously and automatically obtained by pulling on the edge of the band extending from the apparatus. This is the case notably of apparatus which has been made the subject of previous patents by the applicant. See, for example, U.S. Pat. No. 3,896,691.

In these patents, the cutting of the paper is effected by pulling on the end of the band causing drive of a drum having a roughened surface and against which, under pressure, rolls a roll of paper, the drum being equipped with a cutting tool (bar, blade, wire etc.) which at the time of its rotation comes into progressive contact over the entire length of a counter tool to effect a cutting action in the manner of a scissors.

Next will be briefly summarized the characteristics of the apparatus which is the subject of the preceding patents of the Applicant.

The apparatus is of the type comprising a carrier for a roll of paper maintained under pressure against a rotatable drum mounted on a frame fixed to a wall casing and carrying at one side a profiled pawl cooperating, selectively with a shock absorber or with an elastic abutment according to the phases of operation and at the other side an eccentric lever with a return spring for the drive of the drum in order to cut, by manual action the band of paper leaving the apparatus.

SUMMARY OF THE INVENTION

According to the present invention, it is desired to simplify the apparatus, to render it more reliable and to diminish the pulling force to be exerted on the end of the web in order to cut it thereby to increase its effectivity.

For this purpose there is employed a cutting apparatus permitting the elimination of the counter tool or fixed cutting member and assuring a cutting, no longer progressively in the manner of a scissors, but instantaneously by a single cut.

The apparatus according to the invention is characterized in that it has in the drum driven by traction by the paper a toothed cutting apparatus which at the time of rotation of the drum describes a trajectory in the direction of rotation of the drum to pass from a retracted position in the drum to an operative projecting position to penetrate into the paper, which is pulled on both sides of the cutting apparatus by pressure bearing contact on the roll of material against the drum on one side and by the traction on the material on the other side.

According to one characteristic feature, a toothed cutting apparatus is internally pivoted to the drum and carries on one of its articulation axles a wheel, roller or equivalent means which bears against a fixed cam carried by one of the bearings of the drum which is shaped and oriented to displace the cutting apparatus to projected position from the drum in order to cut the manually pulled material.

According to another characteristic feature, the apparatus comprises two arrangements for distribution and cutting of the material, namely two carriers for rolls of material and two drums with their respective operating members (pawl, shock absorber or abutment, eccentric lever, cutting apparatus, cam, etc.) operated alternately or simultaneously by pivotally mounting a lever on a flange of the framework of one of the drums, said lever cooperating with the carriers of the rolls of material or with the arrangement of the drums in order to block one of the drums in the case of alternate use.

These and other characteristic features will follow from the subsequent description.

To make the objects of the invention clear without otherwise limiting it, various embodiments are illustrated in the annexed drawing.

BRIEF DESCRIPTION OF THE DRAWINGS

FIG. 1 is an exploded perspective view of separate element of the apparatus according to the invention;

FIGS. 2 and 3 are respective views in section and elevation showing the drive means of the cutting apparatus according to a first embodiment;

DETAILED DESCRIPTION

Figure 4:
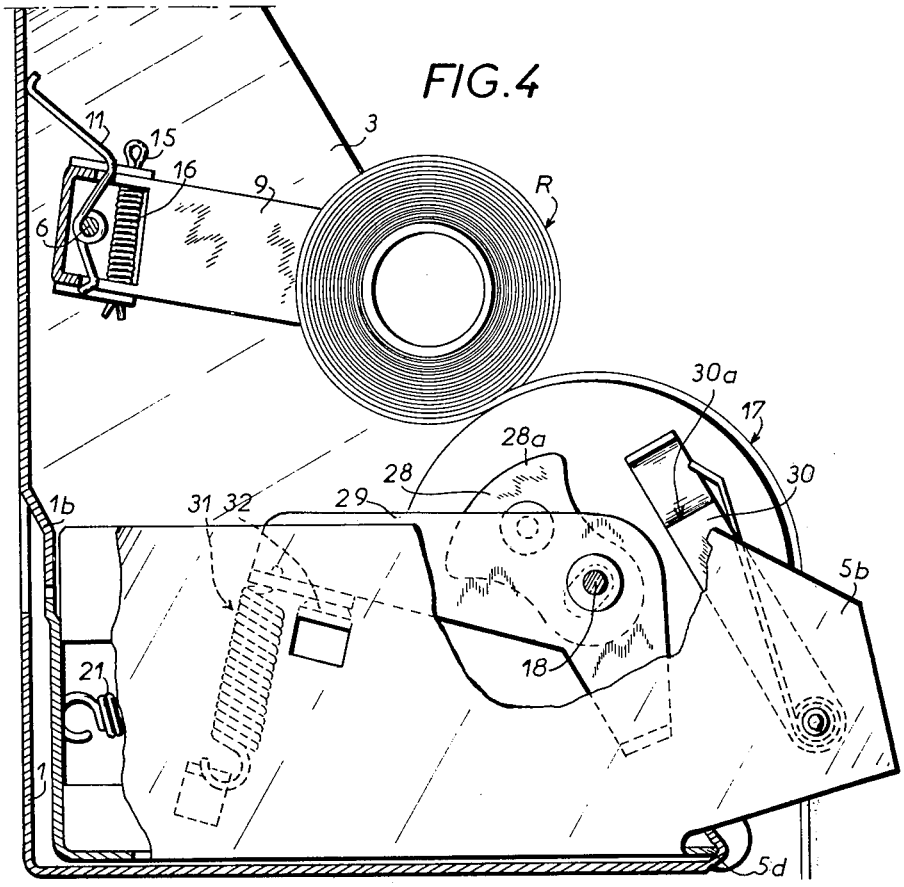
FIG. 4 is a transverse sectional view showing the known mechanisms entering into the operation of the apparatus in the course of application of tension on the material.

In order to make the objects of the invention more concrete there will now be described in non-limiting manner the embodiments illustrated in the figures of the drawings.

The apparatus illustrated in FIGS. 1–6 is of similar type as that described in U.S. Pat. No. 3,896,691. There will be summarized hereafter the mounting of the various elements in order to better understand the operation of the improvement of the apparatus of the present invention.

In FIG. 1 there is shown the main elements of the apparatus, namely wall casing A, roller carrier B and the mechanism C.

The wall casing comprises sheet material forming a vertical wall and 1 and a base 2. At the lateral sides of the wall and the base are bent sides or flanges 3 of generally triangular shape on which is pivotably mounted a hood or cover 4 of sheet metal or plastic material.

The wall 1 has vertical and horizontal slots 1*a* for mounting purposes, and adjacent its lower portion the wall is provided with a pushed-in tab 1*b* entering the interior. The base 2 is folded at 2*a* along its free edge. Tab 1*b* and edge 2*a* are adapted to receive, by a snap fit, the mechanism C which includes, in this respect, a body having a rear wall 5*a* and two side walls on flanges 5*b*. The wall 5*a* has at its upper edge a lock tab 5*c* to engage under the tab 1*b* of the casing whereas the flanges 5*b* have inwardly projecting bend portions 5*d* at their lower edges which can engage on the folded edge 2*a* of the casing and under wall 2.

The roller carrier B is also mounted by simple snap fit on the casing through the intermediary of a shouldered shaft 6 traversing the roller carrier and laterally projecting therefrom which is elastically engaged in holes formed in push tabs 3*a* of the flanges 3 of the casing bent parallel to these flanges.

The roller carrier B comprises rigid profiled member 7 having one extremity fixed to a fixed arm 8 and at its other a movable arm 9 which is pivotably connected thereat.

The shaft 6 is pivotably mounted in the tabs 3*a* of flanges 3 of the casing and the shaft passes through the fixed arm 8 and through a U shaped plate 10 fixed to the member 7 on which movable arm 9 is pivoted. To constantly urge the roll of material R against the drum, springs 11 are mounted on a shaft and have extremities bearing in compression on the casing.

The roll R is carried for rolling at the side of the fixed arm by a slotted ring 12 cooperating with a pin with projections (not shown) engaged in the hub of the roller.

The movable arm 9 is pivotably supported by a pin 15 and elastically urged against the roll by a suitably disposed coil spring 16. The arm 9 has a bent finger grip 9*a* at its extremity to facilitate manipulation of the arm to mount a roll of material.

Figure 7:
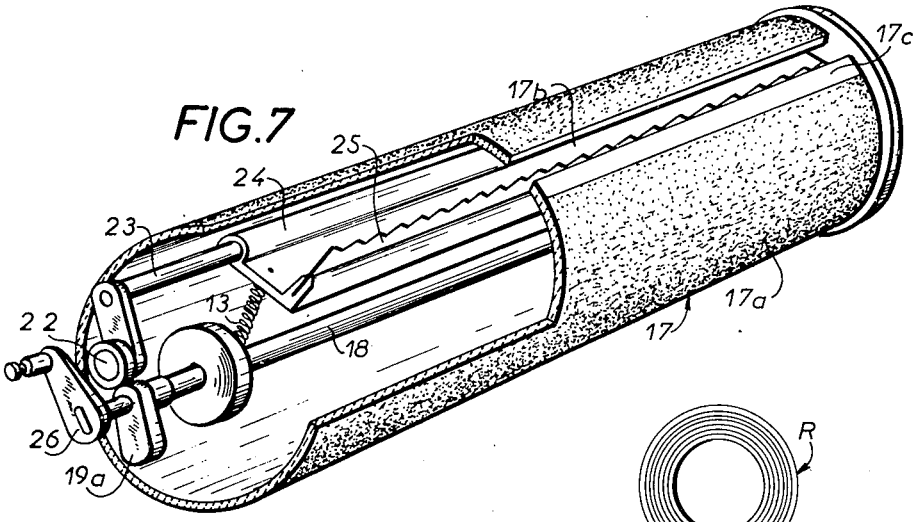
FIG. 7 is a perspective view, in partial section, showing the cutting arrangement according to a first embodiment of the invention in its retracted position in the drum.

According to a first embodiment illustrated in FIGS. 2, 3, 7, 8, 9 and 10, the drum 17 for driving the material is mounted by its shaft 18 in two bearings 19, 20 engaged in notches 5*a* of flanges 5*b*. The bearing 19 is traversed by a lever 26 fixed to the shaft 18 and at the end of which is engaged a spring 21 connected to the wall 5*a* and adapted to store energy during an initial period of rotation of the drum produced by pulling the free end of the roll of material until a dead point is reached whereafter the spring now releases its energy to drive the drum in the same direction. At the interior side of the flange 5*b*, the bearing 19 has a cam 19*a* which cooperates with the cutting apparatus through the intermediary of a roller 22 angularly fixed to a rotation shaft 23 of a cutting tool carrier 24 traversing the wall of the drum (FIG. 7).

In an advantageous manner, the tool carrier is made as a single molded piece, the tool itself being either a toothed metallic blade 25 embedded in the tool carrier (as shown) or a tooth blade of molded material integral with the carrier.

At the side of the bearing 20, there is disposed on shaft 18 of the drum a pawl 28 and a shock absorber 29. These members as well as an abutment 30 pivoted on the flange 5*b* participate in the cutting operation according to the following phases.

Figure 8:
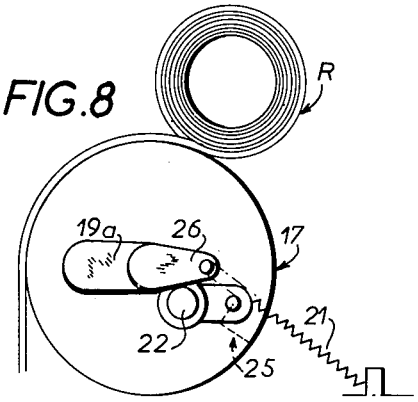
FIGS. 8, 9 and 10 are schematic view illustrating the cutting arrangement of FIG. 7 in three different operational phases.
Figure 9:
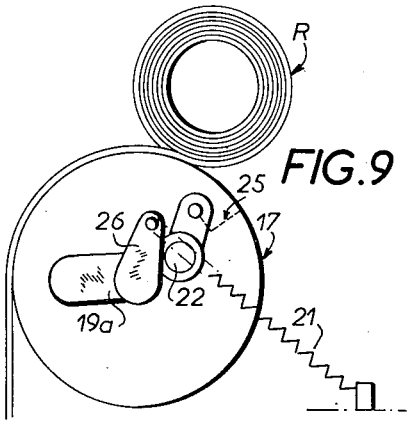
Figure 10:
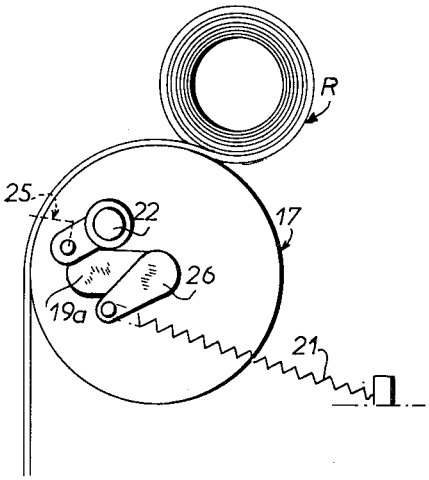

When one pulls on the free end of the web of material, the drum 17 with its roughened surface 17*a* is driven in rotation. The spring 21 is stressed and when the lever 26 has passed the dead-point, the drum is vigorously driven by the energy absorbed by the spring. Concurrently, the roller 22 which is fixed to the shaft 23 of the tool carrier is displaced around the cam 19*a* (FIG. 8).

When the dead-point is reached, the roller 22 causes the tool carrier to pivot which produces exit of the blade 25 through slot 17*b* in the drum making it describe an arc of a circle spaced from the drum (under the rotation effect of the drum). The paper pulled by the user and combined with the pressure of the roll carrier on the drum, it is seen that the teeth of the blade 25 penetrate into the taut paper and effect a clean instantaneous cut.

During this action, the portion 28*a* forming a cam on the pawl 28 passes in front of the abutment 30 displacing it against the action of its return spring.

Figure 5:
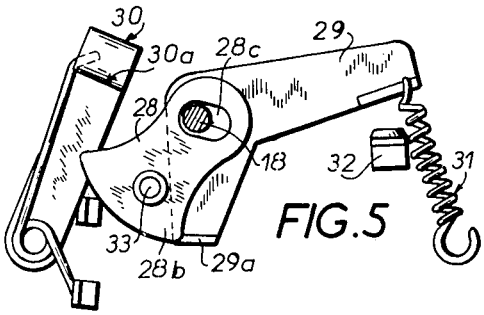
FIGS. 5 and 6 show the action of the mechanisms according to FIG. 4 in two different operational phases, respectively, in braking of the drum and in abutment of the drum.
Figure 6:
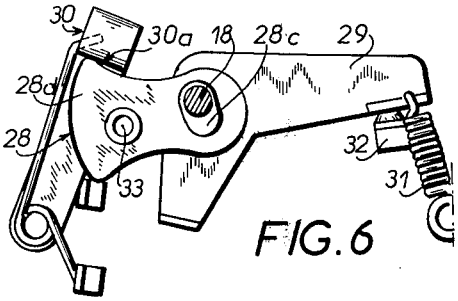

After the cut, the drum by its own inertia travels through a certain arc of a circle up to contact of the extremity 28*b* of the pawl with perpendicularly projecting portion 29*a* of the shock absorber which in turn is then driven in rotation (FIG. 5). The shock absorber is elastically retained by spring 31 and thereby the drum is braked and stopped. The shock absorber travels in reverse direction under the action of stressed spring 31 to contact an abutment 32 formed on a flange to produce a rebound effect. Portion 28*d* of the pawl 28 then contacts a perpendicular portion 30*a* of the abutment 30 which then prevents the rearward return movement of the drum (FIG. 6).

The pawl 28 is mounted on the shaft 18 of the drum by an oblong slot 28*c* and is indexed by a shaft 33, and it is seen that by its own weight the pawl, according to its angular position rocks along this slot either to abut against the shock absorber in the movement of free fall or to escape from the shock absorber at the time of a new pulling action on the paper.

During this time, the wheel 22 which has finished turning on the extremity of the cam 19*a* returns the tool carrier to its retracted position in the drum through the intermediary of return spring 13 attached to the tool carrier and to a flange of the drum.

It is to be noted that to obtain a perfect tension in the paper on opposites sides of the cutting blade (tension obtained upstream by the pressure of the paper roll against the drum) there is fixed on the interior wall of the cover 4 a means for pressing the paper against the drum. This means must be flexible in order not to interfere with the drive and must allow passage of the cutting blade. For this purpose, there is provided a member 34 of the brush or wiper type having bristles which allow passage of the teeth of the blade without damaging them.

Additionally provided on the drum ahead of slot 17*b* is a smooth band 17*c* (FIG. 7) slightly projecting outwards with respect to the roughened surface. The band 17*c* avoids drive of the paper by adherence at this location at the time when the paper is above the outlet opening of the cover when the paper exits under the action of drive of the drum.

In certain cases of utilization of the apparatus, there is mounted in the same support and under the same cover or hood two devices for distribution and cutting according to the invention.

This is the case particularly in the circumstances where a number of undetermined persons can utilize the sanitary apparatus, for example, train stations, airports, expositions, large areas etc. At these places, a specialized service is generally charged for the maintenance and supply of the apparatus. However this service extends to regular hours each day according to any other frequency. It would be undesirable for the user to find at a particular time a number of empty devices.

To avoid this disadvantage, a second cutting and distributing device for paper is mounted in the casing in a manner such that the devices can be simultaneously utilized alternatively.

Figure 11:
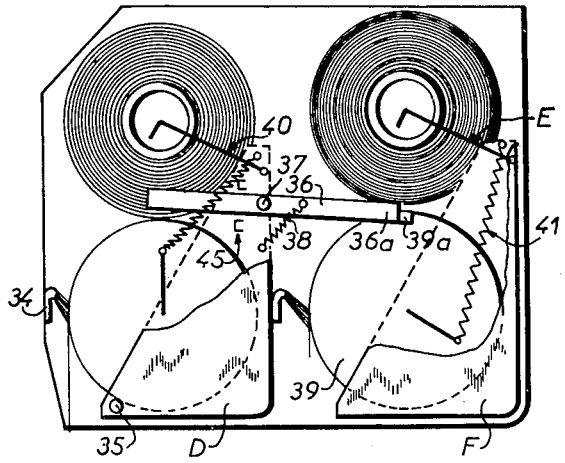
FIGS. 11, 12 and 13 illustrate in schematic fashion an embodiment of the apparatus with two arrangements for distribution and cutting.
Figure 12:
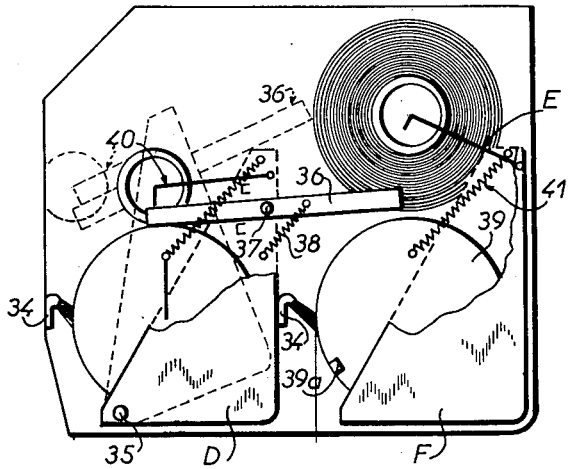

For this purpose a number of embodiments can be employed. Schematically illustrated in FIGS. 11 and 12 is a first embodiment according to which the two devices are arranged one behind the other. The first device D can be articulated at 35 to the casing in order to allow mounting of a second roller carrier E (FIG. 12).

In this embodiment one or the other of the devices D, F is utilized in the followed manner:

Assuming the two rollers are full (FIG. 11) and it is desired to utilize device D. It is therefore necessary to block device F to prevent its utilization.

For this purpose there is provided a lever 36 pivoted at 37 at its central portion to a flange of the device D. Lever 36 is constantly urged into the position illustrated in FIG. 11 by a spring 38 such that its rear extremity 36*a* faces a projection 39*a* on the drum 39 of the second device thus preventing its rotation, it being understood that the paper does not project beneath the cover.

When the first roller is almost finished, its support arms 40 bear on the front of the lever 36 and push against it up to the time that the first roller is empty. At this instant, the lever is rocked (FIG. 12) the drum 39 is freed and the drive spring 41 which is stressed causes the roller to turn in order to eject an edge of the paper band. One can then utilize the second roll of paper.

The maintenance personnel then places a new roll of paper in the first device and optionally in the second. The support arm 40 ascends, the lever 36 automatically pivots again to block the drum 39 while the personnel takes precaution to place it in abutment that is to say in tension.

Figure 13:
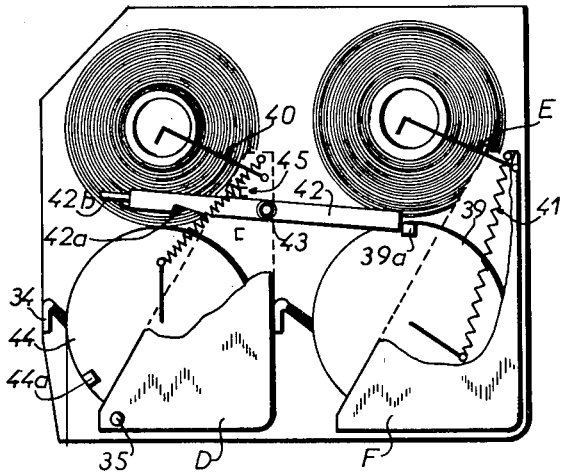

According to the embodiment illustrated in FIG. 13, it is possible to utilize the two devices either simultaneously or alternatively.

For this purpose, the lever 42 is no longer biassed by a spring to a forwardly raised position but is solely equipped with a brake 43 on the axis of articulation, for example, in order to maintain it in selected positon. In this case, the first device has on its drum 44 a projection 44*a* at the same position as projection 39*a* of the drum 39 and the lever has a notch 42*a* at its front. When the first roll is exhausted its support arm 40 pushes against the lever and the notch 42*a* engages the abutment 44*a*. The second device is free as before.

When a new roll of material is replaced on the first device, the lever can either be left in position to finish the utilization of the second roll or it can be raised by means of engageable extremity 42*b* in order to utilize the new roll on the first device while blocking the second device.

One can also place the lever in an intermediate position in order to free both mechanisms and thus utilize the two rolls.

It is to be noted that the levers 36 and 42 have a limited travel limited by abutments 45 on the flanges of the first device in order to be contacted only when the roll is almost finished. On the other hand, a second member 34 for holding the paper on the drum is positioned behind the first device for operation with the second drum.

It is seen that the cutting blade thus mounted and controlled by simple pulling on the material driving the drum in rotation permits a clean and instantaneous cut. Whatever the quality of the material to be distributed, this is obtained by the profile of the cam, the drive of the drum through the eccentric lever, the roughened surface of the drum, the pressure bearing of the roll of material on the drum serving the role of a counter blade and the force of penetration of the tooth blade.

The invention is not limited only to the disclosed embodiment or to the modes of utilization and the various portions thereof, but in contrast it embraces all variations covered by the appended claims.

What is claimed is:

1. An apparatus for successively cutting and simultaneously distributing sections from a web of roll material, the apparatus having a casing, a carrier for a roll of material mounted in the casing, a rotatable drum in said casing, said carrier being urged towards said drum such that the roll of material is frictionally engaged with the drum to cause the drum to be driven in rotation by manual traction applied to a free end of the material extending from the casing, said drum having opposite ends, a profiled pawl supported at one of the ends of the drum, elastic means positioned to engage said pawl for braking the rotation of said drum and halting the drum after one revolution thereof, an eccentric lever mounted at the other end of said drum for rotation therewith, energy storage means engaging said lever for resisting rotation of the drum during an initial period of rotation thereof while storing energy and then driving the drum in rotation by the stored energy, and cutting means for cutting the material on said drum, an improvement wherein said drum is hollow, said cutting means comprising a cutting member pivotably mounted in said drum for movement between operative and inoperative positions, cam means for pivotably moving the cutting member to its operative position by the drive of the drum, said drum having a slot therein, said cutting member being retracted in said drum in said inoperative position and projecting from said slot in said operative position, said cutting member being displaced by said cam means under the drive of the drum along a trajectory in the same direction of rotation of the drum to reach said operative position and cut the material to free a section thereof for release under the manual traction in the course of rotation of the drum.

2. Apparatus as claimed in claim 1 wherein said cutting member has a toothed cutting edge.

3. Apparatus as claimed in claim 2 wherein said cam means is shaped to act on said cutting member to displace the same to operative position and cut the material at a location just beyond that at which the roll of material contacts the drum.

4. Apparatus as claimed in claim 1 wherein said cutting means comprises a carrier of molded material and a toothed blade partially embedded in said carrier.

5. Apparatus as claimed in claim 1 comprising a frame secured to said casing and rotatably carrying said drum, said cam means being fixed to said frame, and follower means rotatably carried by said cutting means and engaging said cam means for pivotably displacing said cutting member.

6. Apparatus as claimed in claim 5 wherein said cutting means comprises a carrier and a blade secured to said carrier, said carrier including two arms extending perpendicularly to said blade, a branch secured to one of said arms and extending perpendicularly thereto in the same plane therewith, said branch having an extremity pivotably connected to said drum, said follower means being rotatably mounted on said one arm at the junction thereof with said branch, said follower means being operatively engaged with said cam means.

7. Apparatus as claimed in claim 6 wherein said follower means comprises a roller rotatably mounted on said one arm.

8. Apparatus as claimed in claim 5 wherein said cutting means has an axis of rotation relative to the axis of rotation of said drum such that said cutting member has a pre-determined magnitude of projection from said drum during a pre-determined portion of the revolution of said drum according to the material to be cut and dispensed.

9. Apparatus as claimed in claim 5 wherein said drum has side flanges rotatably mounted in said frame, one flange including an axle rotatably mounted in said frame and carrying said pawl and elastic means, a second axle secured to the other flange and to said eccentric lever and rotatable in said frame, 10. Apparatus as claimed in claim 5 comprising a shaft carrying said cutting means and rotatably supported on said drum and extending therefrom, said follower means being secured to said shaft and bearing on said cam means.

11. Apparatus as claimed in claim 10 comprising bearings on said frame for said drum, said cam means being secured to one of said bearings, said follower means including an arm secured to said shaft and a roller rotatably mounted on said arm, said cam means and follower means being angularly oriented relative to one another and to said eccentric lever to cause said cutting means to move to its operative position after passage of a dead-point by the eccentric lever, and a spring connecting said drum and said cutting means urging the latter to its inoperative position.

12. Apparatus as claimed in claim 1 wherein two assemblies of drums and carriers are mounted in said casing adjacent one another and are associated with respective pawls, elastic means, eccentric levers, energy storage means, cutting means, and cam means, said apparatus further comprising means for selectively blocking one of said assemblies.

13. Apparatus as claimed in claim 12 wherein said selective blocking means comprises a pivotal lever having an operative position for blocking said one assembly.

14. Apparatus as claimed in claim 13 wherein said assembly includes a frame secured to the casing and supporting the associated drum, said pivotal lever being pivotably mounted on the frame of the other of the assemblies.

15. Apparatus as claimed in claim 14 wherein said one assembly is arranged behind the other assembly, said lever having a rear extremity, said drum of the rear assembly including a projection engaged by said lever in its operative position whereby rotation of the drum is blocked.

16. Apparatus as claimed in claim 15 comprising a spring acting on lever to pivot the same upwardly at its front and downwardly at its rear to engage said projection on the drum of the rear assembly.

17. Apparatus as claimed in claim 15 comprising an arm carried on the carrier of the front assembly and positioned to bear against said lever when the roll of material on the carrier is spent to pivot said lever downwardly to inoperative position and free the projection on the rear drum whereby this rear assembly is now unblocked and adapted for operation.

18. Apparatus as claimed in claim 17 comprising brake means coupled to said lever in the vicinity of the pivot point thereof to maintain said lever in operative or inoperative position or in a neutral horizontal position.

19. Apparatus as claimed in claim 18 wherein said lever has a front portion with a slot, said front drum having a projection engagable in said slot when the lever is pivoted downwardly by said arm to block rotation of said front drum.

20. Apparatus as claimed in claim 17 comprising abutment means supported by said drum of the front assembly to limit angular pivotal movement of said lever only when the roll of material on the front carrier is almost empty.

21. Apparatus as claimed in claim 15 comprising means pivotably mounting the assembly at the front to said casing to provide access to the carrier of the rear assembly for the roll of material.

22. Apparatus as claimed in claim 1 comprising a flexible bearing member secured to said casing and bearing against the material passing on the drum to enforce tension in the material on both sides of the cutter means while permitting passage of said cutting member therepast in its operative position.

23. Apparatus as claimed in claim 1 wherein said drum has a roughened surface to facilitate frictional engagement with the material, the drum further comprising a band of smooth material bordering the front of said slot and projecting slightly outwardly of the roughened surface of the drum to prevent adherence with the material after the same has been cut by the cutting member.

* * * * *